US008815025B2

(12) United States Patent
Yokota et al.

(10) Patent No.: US 8,815,025 B2
(45) Date of Patent: Aug. 26, 2014

(54) HIGH STRENGTH STEEL EXCELLENT IN UNIFORM ELONGATION PROPERTIES AND METHOD OF MANUFACTURING THE SAME

(75) Inventors: Takeshi Yokota, Kawasaki (JP); Akio Kobayashi, Kawasaki (JP); Kazuhiro Seto, Kawasaki (JP); Yoshihiro Hosoya, Chiba (JP); Thomas Heller, Duisburg (DE); Brigitte Hammer, Voerde (DE); Rolf Bode, Wesel (DE); Günter Stich, Bochum (DE)

(73) Assignees: JFE Steel Corporation (JP); ThyssenKrupp Steel AG (DE)

( * ) Notice: Subject to any disclaimer, the term of this patent is extended or adjusted under 35 U.S.C. 154(b) by 692 days.

(21) Appl. No.: 11/592,613

(22) Filed: Nov. 3, 2006

(65) Prior Publication Data

US 2007/0119521 A1 May 31, 2007

(30) Foreign Application Priority Data

Nov. 25, 2005 (JP) ..... 2005-340554

(51) Int. Cl.

| | |
|---|---|
| ***C22C 38/06*** | (2006.01) |
| ***C22C 38/12*** | (2006.01) |
| ***C22C 38/14*** | (2006.01) |
| ***C21D 8/02*** | (2006.01) |
| ***C22C 38/04*** | (2006.01) |

(52) U.S. Cl.

CPC ..... *C21D 8/0226* (2013.01); *C22C 38/12* (2013.01); *C22C 38/06* (2013.01); *C22C 38/14* (2013.01); *C22C 38/04* (2013.01)

USPC ..... 148/328; 148/661; 148/664; 420/103; 420/104

(58) Field of Classification Search

USPC ..... 148/559, 579, 645, 648, 654, 660, 661, 148/400, 320; 420/8, 103, 123, 124, 126, 420/127

See application file for complete search history.

(56) References Cited

U.S. PATENT DOCUMENTS

| | | | | |
|---|---|---|---|---|
| 5,470,529 | A * | 11/1995 | Nomura et al. | 420/103 |
| 2005/0081966 | A1* | 4/2005 | Kashima et al. | 148/651 |
| 2005/0133124 | A1* | 6/2005 | Kawano et al. | 148/546 |

FOREIGN PATENT DOCUMENTS

| | | | | |
|---|---|---|---|---|
| EP | 0 997 548 | A1 | 5/2000 | |
| EP | 1 350 859 | A1 | 10/2003 | |
| EP | 1 486 574 | A1 | 12/2004 | |
| JP | 4-228538 | A | 8/1992 | |
| JP | 6-200351 | A | 7/1994 | |
| JP | 06-264183 | A | 9/1994 | |
| JP | 6-264183 | A | 9/1994 | |
| JP | 7-11382 | A | 1/1995 | |
| JP | 2000-336455 | A | 12/2000 | |
| JP | 2002-322539 | A | 11/2002 | |
| JP | 2002-322540 | A | 11/2002 | |
| JP | 2002-322541 | A | 11/2002 | |
| JP | 2002-322543 | A | 11/2002 | |
| JP | 2003-89848 | A | 3/2003 | |
| JP | 2003-138343 | A | 5/2003 | |
| JP | 2003-138344 | A | 5/2003 | |
| JP | 2003-321738 | A | 11/2003 | |
| JP | 2004-027249 | * | 1/2004 | ..... C22C 38/00 |
| JP | 2004-143518 | * | 5/2004 | |
| JP | 2004-143518 | A | 5/2004 | |
| WO | 03/010351 | A | 2/2003 | |

OTHER PUBLICATIONS

JP 2004-143518. Machine Translation.*

Higgins, Raymond A., Engineering Metallurgy, Part I: Applied Physical Metallurgy, 6th edition, Arnold Publishing, 1993. Ch. 13, pp. 285-332. (58 pages total, including front matter and table of contents).*

Higgins, Raymond A., Engineering Metallurgy, Part I: Applied Physical Metallurgy, Sixth edition, Arnold, 1993, Ch. 8, pp. 160-178.*

Computer-Generated Translation of JP 06-264183, originally published in the Japanese language on Sep. 20, 1994.*

Computer-generated translation of JP 2004-027249, published in Japanese on Jan. 29, 2004.*

"Glossary of Metallurgical and Metalworking Terms," Metals Handbook, ASM International, 2002, term(s): galvanize.*

* cited by examiner

*Primary Examiner* — Scott Kastler
*Assistant Examiner* — Vanessa Luk
(74) *Attorney, Agent, or Firm* — DLA Piper LLP (US)

(57) ABSTRACT

A high strength steel, including about 0.05 to about 0.25% of C, less than about 0.5% of Si, about 0.5 to about 3.0% of Mn, not more than about 0.06% of P, not more than about 0.01% of S, about 0.50 to about 3.0% of Sol. Al, not more than about 0.02% of N, about 0.1 to about 0.8% of Mo, about 0.02 to about 0.40% of Ti, and the balance of iron and unavoidable impurities, wherein the steel has a structure formed of at least three phases including a bainite phase, and a retained austenite phase in addition to a ferrite phase having a composite carbide containing Ti and Mo dispersed and precipitated therein, wherein the total volume of the ferrite phase and the bainite phase is not smaller than 80%, the volume of the bainite phase is about 5% to about 60%, and the volume of the retained austenite phase is about 3 to about 20%.

12 Claims, No Drawings

HIGH STRENGTH STEEL EXCELLENT IN UNIFORM ELONGATION PROPERTIES AND METHOD OF MANUFACTURING THE SAME

TECHNICAL FIELD

This disclosure relates to a high strength steel sheet having a strength not lower than 780 MPa and excellent in the balance between the strength (TS) and the uniform elongation (U·EL) and suitable for use as a raw material of the member to which is applied some working such as a press forming, a bending process or a stretch flanging process.

BACKGROUND

With enhancement of the attentions paid to the environmental problem, efforts are being made in an attempt to decrease the weight of the part by increasing the strength of the part and by decreasing the thickness of the part. Further, with expansion of the field to which a high strength steel sheet is applied, the press forming tends to be employed widely for performing a complex process even in the case of handling a high strength steel sheet, with the result that required is a material having a high strength and, at the same, excellent in the workability.

Particularly, in the field of the automobile, the high strength steel sheet is required to exhibit various properties in addition to the balance between the strength and the stretch flangeability. To be more specific, required are (1) a high yield ratio (YS/TS>0.7) in view of the safety in the event of a car crash, (2) an excellent balance between the strength and the uniform elongation (TS×U·EL>12,000) in view of the bulging properties, and (3) a good plating capability in view of the durability of the part (in general, Si<0.5% is one of the absolutely required conditions). Particularly, concerning the uniform elongation, i.e., requirement (2) given above, an improvement in the uniform elongation is a very important factor nowadays because the ductility until the starting of the necking after the yield point has come to be required in accordance with the complex shaping of the part and the shortening of the press forming time, which are required nowadays. However, it is very difficult for the conventional technology to satisfy simultaneously all the requirements (1) to (3) given above.

It was customary in the past to use a high strength steel sheet for the manufacture of a structural part and, thus, the stretch flangeability has been evaluated as more important than the bulging properties. Therefore, many methods have been proposed to date for satisfying the requirements for both the high strength and the high stretch flangeability. For example, proposed in each of JP-A-7-11382 and JP-A-6-200351 identified hereinafter is a steel sheet exhibiting an excellent hole expanding ratio in spite of a high strength not lower than 700 MPa. Specifically, it is proposed in patent document 1 that TiC or NbC is precipitated in the acicular ferrite structure so as to obtain a steel sheet excellent in the hole expanding ratio. On the other hand, it is proposed in JP-A-6-200351 that, in order to increase the hole expanding ratio of the steel sheet, at least 85% of the structure of the steel sheet is formed of a polygonal ferrite, that TiC is precipitated, and that Mo is dissolved. JP-A-7-11382 and JP-A-6-200351 also propose the methods of manufacturing the particular steel sheets. However, where TiC or NbC is utilized for precipitation strengthening as in the patent documents quoted above, it is unavoidable for the precipitate to be enlarged and coarsened, leading to a lowered strength. It is also difficult to secure a sufficient stretch flangeability because the enlarged and coarsened precipitates provide the starting points and the propagating route of the cracking.

In order to overcome the problems pointed out above, proposed in JP-A-2004-143518 referred to hereinafter is a steel sheet containing ferrite as a main phase and having V carbonitride, which has an average carbide diameter not larger than 50 nm, precipitated within the ferrite grains. It is taught that the steel of the particular structure permits improving the total elongation, the hole expanding ratio and the fatigue resistance. However, the structure obtained by this method consists mainly of ferrite and pearlite and is not intended to utilize the retained austenite and martensite (It is taught that it is highly desirable for the amount of the second phase to be 0%). It is not reasonable to state that the steel sheet proposed in patent document 3 is satisfactory in the balance between the strength and the uniform elongation. On the other hand, a steel sheet having a high YS/TS ratio, a good stretch flanging property, and a satisfactory plating property and a method of manufacturing the particular steel are disclosed in each of JP-A-2002-322539, JP-A-2002-322540, JP-A-2002-322541, JP-A-2002-322543, JP-A-2003-89848, JP-A-2003-138343 and JP-A-2003-138344 referred to hereinafter. It is taught that the steel sheet exhibiting the excellent properties can be obtained by the construction that the structure is formed of ferrite and the ferrite structure is reinforced by superfine precipitates containing Ti and Mo and having an average precipitate diameter not larger than 10 nm. The method proposed in these patent documents is highly effective in respect of requirement (1) referred to previously. However, the particular method is incapable of obtaining not only a ferrite single phase structure but also a good balance between the strength and the uniform elongation.

Various methods utilizing the retained austenite (retained γ) are proposed as a measure for improving the balance between the strength and the uniform elongation or between the strength and the entire elongation (EL). For example, a steel sheet excellent in the balance between the strength and the entire elongation and a method of manufacturing the particular steel sheet are disclosed in JP-A-2000-336455 referred to herein later. It is taught that the steel sheet has a composition containing 0.5 to 20 wt % of Si and 0.005 to 0.3 wt % of Ti, that the steel sheet contains ferrite having an average grain diameter smaller than 2.5 μm as a main component, and that the steel sheet has a structure containing bainite having an average grain diameter not larger than 5 μm and at least 5% of the retained γ. However, since the steel sheet is strengthened mainly in this prior art by grain refinement, it is difficult to obtain the requirement of YS/TS>0.7. It is also difficult to obtain the strength not lower than 780 MPa.

Disclosed in each of JP-A-4-228538 and JP-A-2003-321738 referred to hereinafter are a steel sheet having a strength not lower than 780 MPa and an excellent balance between the strength and the entire elongation and a method of manufacturing the particular steel sheet. It is disclosed in JP-A-4-228538 that the ratio of the polygonal ferrite space factor rate to the average grain diameter of the polygonal ferrite is set at 7 or more, and that Si is added in a large amount so as to obtain the steel sheet noted above. On the other hand, JP-A-2003-321738 teaches that the ferrite in the retained γ steel having Si added thereto in an amount of 0.5 wt % or more is reinforced by fine precipitates containing Ti and Mo so as to obtain the steel sheet noted above. In each of these methods, however, required is Si in an amount of 0.5 wt % or more so as to deteriorate the surface properties and to lower the plating capability of the steel sheet.

As a measure for obtaining a retained γ steel without adding a large amount of Si, disclosed in, for example, JP-A-6-

264183 referred to hereinafter is a steel sheet excellent in the balance between the strength and the entire elongation. It is taught that the steel sheet contains 0.8 to 2.5 wt % of Sol. Al and that a fine polygonal ferrite containing at least 5% by volume of retained γ constitutes the main phase of the steel sheet. JP-A-6-264183 also discloses a method of manufacturing the particular steel sheet. In this prior art, a fine polygonal ferrite is used as the main phase of the steel sheet in order to improve the hole expanding ratio. It should be noted in this connection that the fine polygonal ferrite is solid-solution-strengthened by Si alone, or is precipitation-strengthened by TiC or NbC, with the result that the precipitates are enlarged and coarsened in the re-heating stage for applying a molten zinc plating to the surface of the steel sheet so as to give rise to the difficulty that the crystal grains are enlarged and coarsened so as to lower the strength and the hole expanding ratio. In addition, in order to obtain a fine polygonal ferrite, it is necessary to heat the steel sheet between rolls of at least two rear stage stands of a finish rolling mill in a temperature region of $Ar_3$−50° C. to $Ar_3$+100° C. with the total rolling reduction in this temperature region set at 30% or more. It is possible to supply current directly to the roll for heating the roll in order to heat the steel sheet between rolls of the finish rolling mill. In this method, however, special facilities are required. In addition, such a large power as 1,500 kVA is required, leaving room for further improvement in view of the energy saving.

SUMMARY

We provide a high strength steel sheet having a high strength not lower than 780 MPa, a good balance between the strength and a stretch flangeability, a high yield ratio (YS/TS>0.7), an excellent balance between the strength and the uniform elongation (TS×U·EL>12,000), and a good plating property (in general, the condition of Si<0.5% is one of the absolutely required conditions).

We conducted an extensive research on a high tensile steel sheet having a strength not lower than 780 MPa in an attempt to optimize the components and the structure of the steel sheet in a method of improving the balance between the strength and the uniform elongation while retaining a high yield ratio and a good plating property, arriving at findings (i) to (iii) given below:

(i) if a steel sheet has the complex structure containing the ferrite phase and the bainite phase, and the ferritic grain is precipitation-strengthened by fine composite carbides containing Ti and Mo or fine composite carbides containing Ti, Mo and V, it is possible to obtain a high yield ratio, a good elongation and a stretch flangeability even if the structure has a high strength not lower than 780 MPa;

(ii) it is possible to permit an appropriate amount of the austenite phase to retain in the high strength steel sheet and to permit the plating property to be improved, by using Al, not Si, and by utilizing the bainite phase that permits obtaining a high strength;

(iii) the balance between the strength and the uniform elongation can be improved by the combination of findings (i) and (ii) given above.

We provide aspects (1) to (8) given below:

(1) a high strength steel sheet excellent in a balance between the strength and the uniform elongation, characterized in that the steel sheet consists of 0.05 to 0.25% of C, less than 0.5% of Si, 0.5 to 3.0% of Mn, not more than 0.06% of P, not more than 0.01% of S, 0.50 to 3.0% of Sol. Al, not more than 0.02% of N, 0.1 to 0.8% of Mo, 0.02 to 0.40% of Ti by mass percentage, and the balance of Fe and inevitable impurities, the steel sheet has a structure formed of at least three phases including a bainite phase, and a retained austenite phase in addition to a ferrite phase having a composite carbide containing Ti and Mo precipitated therein in a dispersion state, wherein the total volume of the ferrite phase and the bainite phase is not smaller than 80%, the volume of the bainite phase is 5% to 60%, and the volume of the retained austenite phase is 3 to 20%;

(2) a high strength steel sheet excellent in a balance between the strength and the uniform elongation characterized in that the steel sheet consists of 0.05 to 0.25% of C, less than 0.5% of Si, 0.5 to 3.0% of Mn, not more than 0.06% of P, not more than 0.01% of S, 0.50 to 3.0% of Sol. Al, not more than 0.02% of N, 0.1 to 0.8% of Mo, 0.02 to 0.40% of Ti by mass percentage, 0.05 to 0.50% of V, and the balance of Fe and inevitable impurities, the steel sheet has a structure formed of at least three phases including a bainite phase, and a retained austenite phase in addition to a ferrite phase having a composite carbide containing Ti, Mo and V precipitated therein in a dispersion state, wherein the total volume of the ferrite phase and the bainite phase is not smaller than 80%, the volume of the bainite phase is 5% to 60%, and the volume of the retained austenite phase is 3 to 20%;

(3) the high strength steel sheet excellent in a balance between the strength and the uniform elongation according to (1) or (2), characterized in that the composite carbide containing Ti and Mo or the composite carbide containing Ti, Mo and V, which is present in the ferrite phase, has an average carbide diameter not larger than 30 nm;

(4) the high strength steel sheet excellent in a balance between the strength and the uniform elongation according to any one of (1) to (3), characterized in that the steel sheet has a zinc-based plated coating on the surface;

(5) a method of manufacturing a high strength steel sheet excellent in a balance between the strength and the uniform elongation, characterized by comprising steps of hot rolling a steel sheet consisting of 0.05 to 0.25% of C, less than 0.5% of Si, 0.5 to 3.0% of Mn, not more than 0.06% of P, not more than 0.01% of S, 0.50 to 3.0% of Sol. Al, not more than 0.02% of N, 0.1 to 0.8% of Mo, 0.02 to 0.40% of Ti by mass percentage, and the balance of iron and inevitable impurities coiling the hot rolled steel sheet in the temperature range of 350° C. to 580° C.;

(6) a method of manufacturing a high strength steel sheet excellent in a balance between the strength and the uniform elongation, characterized by comprising the steps of hot rolling a steel sheet comprising 0.05 to 0.25% of C, less than 0.5% of Si, 0.5 to 3.0% of Mn, not more than 0.06% of P, not more than 0.01% of S, 0.50 to 3.0% of Sol. Al, not more than 0.02% of N, 0.1 to 0.8% of Mo, 0.02 to 0.40% of Ti by mass percentage, and the balance of iron and inevitable impurities, cooling the hot rolled steel sheet to a coiling temperature at an average cooling rate of 30° C./s to 150° C./s, and coiling the cooled steel sheet in the temperature range of 350° C. to 580° C.;

(7) a method of manufacturing a high strength steel sheet excellent in a balance between the strength and the uniform elongation, characterized by comprising the steps of hot rolling a steel sheet comprising 0.05 to 0.25% of C, less than 0.5% of Si, 0.5 to 3.0% of Mn, not more than 0.06% of P, not more than 0.01% of S, 0.50 to 3.0% of Sol. Al, not more than 0.02% of N, 0.1 to 0.8% of Mo, 0.02 to 0.40% of Ti, and the balance of iron and inevitable impurities, cooling the hot rolled steel sheet to temperatures of 600° C. to 750° C. at an average cooling rate not lower than 30° C./s, subjecting the steel sheet to the air cooling for 1 to 10 seconds within the temperature range noted above, cooling the steel sheet to a coiling temperature at an average cooling rate not lower than 10° C./s, and coiling the cooled steel sheet in the temperature range of 350° C. to 580° C.;

(8) the method of manufacturing a high strength steel sheet excellent in a balance between the strength and the uniform elongation according to any one of (5) to (7), characterized in that the steel sheet further containing 0.05 to 0.50% of V by mass percentage;

(9) the method of manufacturing a high strength steel sheet excellent in a balance between the strength and the uniform elongation according to any one of (5) to (8), characterized by further comprising the step of applying a zinc-based plating to the surface of the steel sheet.

DETAILED DESCRIPTION

We will now describe our disclosure more in detail in respect of the metal structure, the chemical components and the manufacturing conditions.

(Metal Structure)

The metal structure will now be described first.

The high strength hot rolled steel sheet has a complex structure including three phases of the ferrite phase, the bainite phase and the retained austenite phase. The complex structure may possibly include the martensite phase. In the steel sheet, the ferrite phase is strengthened by the composite carbide containing Ti and Mo, or the composite carbide Ti, V and Mo. The particular construction of the complex structure will now be described.

The total volume of the ferrite phase and the bainite phase is not smaller than 80% and the volume of the bainite phase is 5% to 60%:

in general, the ferrite phase, which is excellent in elongation and stretch flangeability, is disadvantageous for obtaining a high strength. On the other hand, the bainite phase is hard and is advantageous for obtaining a high strength. In the case of a single phase, the bainite phase is also excellent in the stretch flangeability. However, when it comes to a complex phase structure consisting of the bainite phase and the ferrite phase, cracks are generated at the interface between the soft ferrite phase and the hard bainite phase so as to lower markedly the stretch flangeability. In order to prevent the stretch flangeability from being lowered, it is effective to diminish the difference in hardness between the ferrite phase and the bainite phase. For diminishing the difference in hardness noted above, it is necessary for the ferrite phase to be strengthened by the composite carbide containing Ti and Mo or the composite carbide containing Ti, V and Mo. Further, since the diffusion of carbon toward the austenite phase (γ-phase) proceeds during the bainite transformation, the γ-phase is stabilized, leading to formation of the retained γ-phase. It follows that the bainite phase is indispensable for increasing the strength and for forming the retained γ-phase. As described hereinafter, Al promotes the ferrite formation and the C diffusion in the austenite phase to promote the formation of the retained austenite phase. These effects are generated mainly during the transformation of $\gamma \rightarrow \alpha$. In order to obtain the retained γ phase with a high stability, it is important to utilize further the bainite transformation so as to promote the diffusion of C toward the γ-phase. Such being the situation, in order to obtain the retained γ-phase in an amount not smaller than 3%, it is necessary for the volume of the bainite phase to be not smaller than 5% even under the condition of the Al addition. On the other hand, if the volume of the bainite phase exceeds 60%, the uniform elongation is lowered. Also, where the sum of the volumes of the ferrite phase which is precipitation-strengthened and the bainite phase is smaller than 80%, the hole expanding ratio is lowered by the formation of a fourth phase such as a martensite phase. Under the circumstances, the sum of the volumes of the ferrite phase and the bainite phase is set at 80% or more, and the volume of the bainite phase is set in the range of 5 to 60%. Incidentally, it is not particularly necessary to define the phase other than the three phases noted above. It is certainly possible for the steel sheet to contain, for example, a martensite phase. However, it is desirable for the amount of the additional phase other than the three phases, e.g., the martensite phase, to be as small as possible.

The volume of the retained γ phase is 3 to 20%:

the retained γ-phase brings about a so-called "TRIP effect" to markedly improve the elongation of the steel sheet. It should be noted that, if the retained γ phase is present in an amount of 3 to 20% in the ferrite phase strengthened by the fine precipitates and the bainite phase, the uniform elongation characteristics in particular are markedly improved. If the volume of the retained γ phase is smaller than 3%, it is impossible to obtain the particular effect sufficiently. Also, in order to obtain the retained γ phase exceeding 20% by volume, it is necessary to increase the addition amounts of C and Al or to apply the reheating during the cooling process after the hot rolling stage. Such being the situation, the volume of the retained γ phase is set in the range of 3 to 20%. Incidentally, the volume of the retained γ phase can be measured by the X-ray diffraction.

Composite carbides containing Ti and Mo, and composite carbides containing Ti, Mo and V:

the composite carbides containing Ti and Mo or composite carbides containing Ti, Mo and V are precipitated finely, compared with TiC that has been used, so as to make it possible to strengthen the steel sheet efficiently. It is considered reasonable to understand that, since the carbide-forming tendency of Mo and V is lower than that of Ti, it is possible for Mo and V to be present finely with a high stability, thereby effectively strengthening the steel sheet with a small addition amount that does not lower the workability of the steel sheet. In addition, if 3 to 20% of the retained γ phase is present in the ferrite phase strengthened by the fine composite carbide particles and in the bainite phase, the uniform elongation characteristics in particular are markedly improved. It is considered reasonable to understand that, since the difference in hardness between the ferrite phase thus strengthened and the bainite phase is small, the ferrite phase and the bainite phase behave like a single phase structure having a high strength and, thus, the TRIP effect is produced in the structure by the retained γ phase. On the other hand, since Ti exhibits a strong carbide-forming tendency, the precipitates tend to be enlarged and coarsened so as to lower the effect on the strengthening of the steel sheet in the case where the steel sheet does not contain Mo, and further, V. Such being the situation, it was necessary to permit a large amount of TiC to be precipitated in order to obtain a required strength of the steel sheet to cause the elongation characteristics to have been lowered. In addition, the composite carbide that does not contain Mo, and further, V is readily enlarged and coarsened when the steel sheet is re-heated to lower the strength of the steel sheet. Under the circumstances, composite carbides containing Ti and Mo or composite carbides containing Ti, Mo and V are finely dispersed in the ferrite.

The average carbide diameter of the composite carbides is not larger than 30 nm:

composite carbides containing Ti and Mo or composite carbides containing Ti, Mo and V tend to be precipitated finely, compared with TiC. Where the average carbide diameter is not larger than 30 nm, the composite carbides contribute more effectively to the strengthening of the ferrite phase to improve the balance between the strength and the uniform elongation and to improve the stretch flangeability. On the other hand, where the average carbide diameter exceeds 30 nm, the uniform elongation and the stretch flangeability of the steel sheet are lowered. Such being the situation, the average particle diameter of the composite carbides is defined not to exceed 30 nm.

Chemical Component

The chemical components will now be described. Incidentally, the expression "%" used in the following description denotes "mass %".

C: 0.05 to 0.25%:

C forms composite carbides containing Ti and Mo or composite carbides containing Ti, Mo and V, which are finely precipitated in the ferrite matrix to impart a high strength to the steel sheet. Also, C diffusion in the austenite phase takes place during the ferrite transformation or the bainite transformation to promote formation of the retained γ phase. However, if the amount of C is less than 0.05%, the retained γ is not formed to lower the elongation characteristics. By contraries, if the C amount exceeds 0.25%, the martensite formation is promoted to deteriorate the stretch flangeability. Such being the situation, the C content is defined in the range of 0.05 to 0.25%.

Si: less than 0.5%:

Si contributes to the solid solution strengthening. In this respect, it is desirable for the steel to contain not less than 0.001% of Si. However, if Si is added in an amount exceeding 0.5%, the surface properties of the steel sheet are impaired and the plating property of the steel sheet is lowered. Such being the situation, the Si content is defined to be less than 0.5%.

Mn: 0.5 to 3.0%:

Mn serves to suppress the cementite formation to promote the C diffusion in the austenite phase and to contribute to the retained γ formation. However, if the Mn content is lower than 0.5%, the effect of suppressing the cementite formation is not produced sufficiently. Also, if the Mn content exceeds 3%, the segregation is rendered prominent to lower the workability of the steel. Such being the situation, the Mn content is set in the range of 0.5 to 3.0%, preferably 0.8 to 2%.

P: not larger than 0.06%:

P, which is effective for promoting the solid solution strengthening, causes the stretch flangeability of the steel to be lowered by segregation and, thus, the amount of P should be decreased as much as possible. Such being the situation, the P content is defined to be 0.06% or less, preferably 0.03% or less.

S: not larger than 0.01%:

S forms a sulfide of Ti or Mn and, thus, causes the effective amount of Ti and Mn to be lowered. Such being the situation, the S content should be lowered as much as possible and, thus, the S content is defined to be 0.01% or less, preferably at 0.005% or less.

Sol. Al: 0.50 to 3.0%:

In general, Al is used as a deoxidizing material. However, Al is used for promoting the ferrite formation and the C diffusion in the austenite phase to promote the formation of the retained austenite without deteriorating the plating property. However, if the amount of Al in the form of Sol. Al is smaller than 0.50%, it is impossible to obtain a sufficient effect of promoting the retained γ formation. On the other hand, if the amount of Sol. Al exceeds 3.0%, the surface defect is increased in the casting stage to deteriorate the elongation and the stretch flangeability. Such being the situation, the content of Sol. Al is set in the range of 0.50% to 3.0%. Further, where the steel has a composite structure of three phases of the ferrite phase, the bainite phase and the retained γ phase and where the ferrite phase is strengthened by composite carbides containing Ti and Mo or composite carbides containing Ti, V and Mo, the Al addition permits improving the balance between the strength and the uniform elongation, compared with the Si addition.

N: not larger than 0.02%:

The amount of N, which is coupled with Ti to form a relatively coarse nitride thereby lowering the amount of the effective Ti, should be decreased as much as possible. Such being the situation, the N content is set at 0.02% or less, preferably 0.010% or less.

Mo: 0.1 to 0.8%:

Mo is required for forming fine precipitates by the coupling with Ti and C and, thus, is an important element. Where the Mo content is lower than 0.1%, fine precipitates are not formed in a sufficiently large amount to make it difficult to obtain a high strength not lower than 780 MPa with a high stability. On the other hand, where Mo is added in an amount exceeding 0.8%, the effect produced by the Mo addition is saturated. In addition, the steel manufacturing cost is increased. Such being the situation, the Mo content is set in the range of 0.1 to 0.8%, preferably 0.1 to 0.4%.

Ti: 0.02 to 0.40%:

Ti is required for forming fine composite carbides by the coupling with Mo and C and, thus, is an important element. However, if the Ti content is lower than 0.02%, fine precipitates of composite carbides are not formed in a sufficiently large amount so as to make it difficult to obtain a high strength not lower than 780 MPa with a high stability. On the other hand, where Ti is added in an amount exceeding 0.40%, the composite carbides formed are rendered coarse to lower the strength of the steel sheet. Such being the situation, the Ti content is set in the range of 0.02 to 0.4%, preferably 0.04 to 0.30%.

V: 0.05 to 0.50%:

V is effective for forming fine composite carbides together with Ti and Mo and, thus, is an important element. Where V is not added, the fine composite carbide grains are precipitated mainly in the form of $TiMoC_2$. However, if V is added, the fine composite carbide grains are precipitated mainly in the form of $(Ti, V)MoC_2$. As a result, the fine composite carbides can be dispersed and precipitated in a larger amount, which is highly effective for increasing the strength of the steel. It follows that the V addition is effective for obtaining a steel sheet having a high strength not lower than 980 MPa. Also, the carbide of V can be dissolved at a relatively low temperature and, thus, V is easily dissolved in the re-heating stage of the slab. It follows that the strength of the steel can be increased more easily, compared with the case of using Ti and Mo alone. However, if the V content is lower than 0.05%, the amount of the finely dispersed composite carbide is not increased sufficiently. On the other hand, where the V addition amount exceeds 0.50%, the composite carbide is enlarged and coarsened so as to lower the strength of the steel. Such being the situation, the V addition amount is set in the range of 0.05 to 0.50%, preferably in the range of 0.1 to 0.40%.

Manufacturing Conditions

The manufacturing conditions (hot rolling conditions) employed will now be described.

The steel sheet can be manufactured by hot rolling a slab having the chemical compositions described above. All the steel making methods generally known to the art can be employed for manufacturing the steel sheet and, thus, the steel making method need not be limited. For example, it is appropriate to use a converter or an electric furnace in the melting stage, followed by performing a secondary refining by using a vacuum degassing furnace. Concerning the casting method, it is desirable to employ a continuous casting method in view of the productivity and the product quality.

It is possible to employ the ordinary process comprising the steps of casting a molten steel, cooling once the cast steel to room temperature, and re-heating the steel so as to subject the steel to a hot rolling. It is also possible to employ a direct rolling process in which the steel immediately after the casting, or the steel further heated after the casting for imparting an additional heat, is hot rolled. In any of these cases, the effect on the steels is not affected. Further, in the hot rolling, it is possible to perform the heating after the rough rolling and before the finish rolling, to perform a continuous hot rolling by joining a rolling material after the rough rolling stage, or to perform the heating and the continuous rolling of the rolling material. In any of these cases, the effect of the present invention is not impaired. Incidentally, it is desirable for the heating temperature of the slab in the range of 1,200 to 1,300° C. in order to dissolve the carbide. Also, it is desirable for the temperature of finish rolling in the hot rolling process to be not lower than 800° C. in order to lower the load of the rolling and to secure the surface properties. Further, it is desirable for the finish rolling temperature to be not higher than 1,050° C. for grain refining.

In the steel sheet, the bainite transformation is utilized for promoting the generation of the retained γ, and the bainite phase is utilized for improving the strength of the steel sheet. It is appropriate to set the coiling temperature after the hot rolling process in a manner to fall within a range of 350° C. to 580° C. in order to generate the bainite phase. If the coiling temperature exceeds 580° C., cementite is precipitated after the coiling process. By contraries, the martensite phase is generated if the coiling temperature is lower than 350° C. to deteriorate the uniform elongation. It follows that it is appropriate to coil the hot rolled steel sheet in the temperature range of 350° C. to 580° C., preferably within a range of 400° C. to 530° C. Incidentally, in order to obtain abovementioned microstructure, it is desirable for the steel sheet after the hot rolling stage to be cooled at an average cooling rate of 30° C./s to 150° C. If the average cooling rate after the hot rolling step is lower than 30° C./s, the ferrite grains and the composite carbide grains contained in the ferrite phase are enlarged and coarsened so as to lower the strength of the steel sheet. Therefore it is preferable that the average cooling rate is not lower than 30° C./s. If the average cooling rate after the hot rolling step is higher than 150° C./s, it is difficult to generate the ferrite grains and the carbide. Therefore it is preferable that the average cooling rate is not higher than 150° C./s.

Further, it is desirable for the cooling process to include the steps of cooling the hot rolled steel sheet to a temperature region falling within the range of 600° C. to 750° C. at an average cooling rate not lower than 30° C./s, air-cooling the steel sheet within the temperature range of 600° C. to 750° C. for 1 to 10 seconds, further cooling the steel sheet to the coiling temperature at an average cooling rate not lower than 10° C./s and, then, coiling the steel sheet in the temperature range of 350° C. to 580° C. The particular cooling process makes it possible to obtain easily the micro structure described above. It should be noted that, if the average cooling rate after the hot rolling step is lower than 30° C./s, the ferrite grains and the composite carbide grains contained in the ferrite phase are enlarged and coarsened so as to lower the strength of the steel sheet. Further, if the air-cooling is performed for 1 to 10 second in the temperature range of 600° C. to 750° C., it is possible to promote the ferrite transformation, to promote the C diffusion in the untransformed γ, and to promote the fine precipitation of composite carbides containing Ti—Mo or Ti—V—Mo in the formed ferrite. If the air-cooling temperature exceeds 750° C., the precipitates are rendered large and coarse to lower the strength of the steel sheet. On the other hand, if the air-cooling temperature is lower than 600° C., the composite carbides are not precipitated sufficiently to lower the strength of the steel sheet. Further, if the air-cooling time is shorter than 1 second, the composite carbides are not precipitated sufficiently. On the other hand, if the air-cooling time is longer than 10 seconds, the ferrite transformation proceeds excessively, resulting in failure to obtain the bainite phase in an amount not smaller than 5%. Also, if the average cooling rate after the air-cooling stage is lower than 10° C./s, pearlite is formed and the stretch flanging ratio is lowered.

Incidentally, the upper limits in respect of the cooling rate after the hot rolling stage and the cooling rate after the air-cooling stage are not particularly specified in the present invention. However, it is desirable for the cooling rate after the hot rolling stage to be not higher than 700° C./s and for the cooling rate after the air-cooling stage to be not higher than 200° C./s.

Incidentally, it is possible to apply plating such as a hot dipping or an electric galvanising to the steel sheet to form a zinc-based plated coating on the surface of the steel sheet. Naturally, the high strength steel sheet of the present invention includes a galvanized steel sheet obtained by forming a zinc-based plated coating on the surface of the steel sheet by the plating treatment described above. It is also possible to apply a chemical treatment to the surface of the steel sheet.

Since the high strength steel sheet exhibits a good workability, the steel sheet retains a good workability even if a plated coating of galvanizing system is formed on the surface. Incidentally, the zinc-based plating noted above denotes the zinc plating and the plating based on zinc. It is possible for the plating to include alloying elements such as Al and Cr in addition to zinc. Incidentally, in the case of the steel sheet having a galvanized plated coating formed on the surface, it is possible to apply the alloying treatment to the plated surface of the steel sheet. When it comes to the annealing temperature before the plating stage in the case of applying the plating by a hot dipping in molten zinc, zinc is not plated on the surface of the steel sheet if the heating temperature is lower than 450° C. On the other hand, the uniform elongation of the steel sheet tends to be lowered, if the annealing temperature exceeds $Ac_3$. Such being the situation, it is desirable for the heating temperature to fall within the range of 450° C. to $Ac_3$.

In the steel sheet, there is no difference in properties between the steel sheet having a black skin surface and the steel sheet after cleaning with an acid. The temper rolling is not particularly limited as far as the temper rolling employed in general is applied. Further, it is desirable to apply the galvanising after the pickling. However, it is possible to apply the zinc-based plating by a hot dipping in a molten metal even after the pickling with an acid or to apply the plating to the steel sheet having a black skin surface.

EXAMPLES

Slabs having the chemical compositions shown in Table 1 were heated to various temperatures, followed by hot rolling the heated slabs to obtain hot rolled steel sheets each having a thickness of 2.0 mm. In preparing the hot rolled steel sheets, the heating temperature, the finish rolling temperature, the cooling rate, and the coiling temperature were changed. The hot rolled steel sheets were pickled thereby preparing samples. For obtaining the hole expanding ratio λ providing a criterion of the stretch flangeability, a steel sample sized 130 mm square was cut out from the steel sheet, followed by making a cutting hole, 10 mmΦ, in the sample by drilling. Then, a conical punch of 60° was pushed up from below and the hole diameter d was measured when the crack penetrated through the steel sheet. The hole expanding ratio λ(%) was calculated by the formula given below:

$$\lambda(\%)=100\cdot(d-10)/10.$$

The mechanical properties were obtained by taking out a JIS 5 tensile strength test piece in a direction of 90° from the rolling direction and by applying a tensile strength test to the test piece. For determining the composition of the composite carbides such as the amounts of Ti, Mo and V contained in the composite carbides, a thin film sample was prepared from the steel sheet, and the composition was determined by the energy dispersion type X-ray spectroscopic apparatus (EDX) of a transmission electron microscope (TEM). Also, for determining the average particle size of the composite carbides, not less than 100 ferrite grains were observed with an observation magnification of 200,000, and the diameters were converted into the diameters of the corresponding circles by an image processing based on the areas of the individual composite carbides. Further, the diameters obtained by the conversion were averaged to obtain the particle size of the composite carbides. The micro structure was identified by using an optical microscope and a scanning electron microscope (SEM) to obtain the area percentage of ferrite and the area percentage of bainite. The area percentage of ferrite and the area percentage of bainite were used as the volume percentage of ferrite and the volume percentage of bainite. Also, the amount of the retained γ (volume percentage) was obtained by the X-ray diffraction.

TABLE 1

Mass %

| Steel | C | Si | Mn | P | S | sol. Al | N | Mo | Ti | V | Remarks |
|---|---|---|---|---|---|---|---|---|---|---|---|
| A | 0.156 | 0.24 | 1.54 | 0.006 | 0.0009 | 1.18 | 0.0042 | 0.23 | 0.12 | — | Inventive Example |
| B | 0.179 | 0.25 | 1.55 | 0.007 | 0.0009 | 0.99 | 0.0046 | 0.40 | 0.21 | — | Inventive Example |
| C | 0.121 | 0.21 | 1.55 | 0.011 | 0.0010 | 1.19 | 0.0040 | 0.17 | 0.08 | — | Inventive Example |
| D | 0.147 | 0.12 | 1.47 | 0.015 | 0.0050 | 0.8 | 0.0039 | 0.18 | 0.11 | — | Inventive Example |
| E | 0.153 | 0.06 | 0.92 | 0.014 | 0.0021 | 2.4 | 0.0025 | 0.22 | 0.12 | — | Inventive Example |
| F | 0.210 | 0.11 | 1.01 | 0.012 | 0.0022 | 1.22 | 0.0028 | 0.22 | 0.36 | — | Inventive Example |
| G | 0.165 | 0.33 | 1.03 | 0.011 | 0.0011 | 1.35 | 0.0024 | 0.12 | 0.17 | — | Inventive Example |
| H | 0.152 | 0.24 | 1.54 | 0.012 | 0.0009 | 1.21 | 0.0045 | 0.04 | 0.13 | — | Comparative Example |
| I | 0.177 | 0.24 | 1.55 | 0.015 | 0.0009 | 0.45 | 0.0043 | 0.24 | 0.13 | — | Comparative Example |
| J | 0.153 | 1.12 | 1.54 | 0.013 | 0.0009 | 0.05 | 0.0044 | 0.24 | 0.14 | — | Comparative Example |
| K | 0.160 | 0.25 | 1.55 | 0.017 | 0.0010 | 1.16 | 0.0051 | 0.24 | 0.13 | 0.08 | Inventive Example |
| L | 0.161 | 0.23 | 1.53 | 0.012 | 0.0009 | 1.17 | 0.0046 | 0.21 | 0.12 | 0.21 | Inventive Example |
| M | 0.183 | 0.25 | 1.54 | 0.012 | 0.0010 | 1.18 | 0.0042 | 0.24 | 0.12 | 0.32 | Inventive Example |
| N | 0.157 | 0.18 | 1.45 | 0.012 | 0.0022 | 1.22 | 0.0038 | 0.23 | 0.09 | 0.43 | Inventive Example |
| O | 0.098 | 0.02 | 0.82 | 0.011 | 0.0018 | 0.82 | 0.0021 | 0.13 | 0.08 | 0.19 | Inventive Example |
| P | 0.157 | 0.26 | 1.54 | 0.010 | 0.0010 | 1.2 | 0.0039 | 0.14 | 0.08 | 0.21 | Inventive Example |
| Q | 0.105 | 0.24 | 1.55 | 0.011 | 0.0010 | 1.19 | 0.0041 | 0.29 | 0.14 | 0.22 | Inventive Example |
| R | 0.139 | 0.02 | 1.49 | 0.012 | 0.0090 | 1.11 | 0.0040 | 0.23 | 0.35 | 0.19 | Inventive Example |
| S | 0.142 | 0.03 | 1.52 | 0.011 | 0.0010 | 1.22 | 0.0039 | 0.38 | 0.11 | 0.21 | Inventive Example |
| T | 0.155 | 0.03 | 1.51 | 0.011 | 0.0011 | 0.57 | 0.0039 | 0.23 | 0.12 | 0.18 | Inventive Example |
| U | 0.162 | 0.03 | 1.52 | 0.011 | 0.0011 | 2.36 | 0.0042 | 0.22 | 0.11 | 0.20 | Inventive Example |
| V | 0.220 | 0.03 | 1.52 | 0.014 | 0.0012 | 1.28 | 0.0042 | 0.23 | 0.11 | 0.21 | Inventive Example |
| W | 0.270 | 0.03 | 1.51 | 0.014 | 0.0009 | 1.29 | 0.0041 | 0.23 | 0.13 | 0.22 | Inventive Example |
| X | 0.320 | 0.25 | 1.53 | 0.006 | 0.0010 | 1.3 | 0.0042 | 0.21 | 0.12 | 0.11 | Comparative Example |
| Y | 0.158 | 0.27 | 1.55 | 0.008 | 0.0010 | 3.11 | 0.0040 | 0.22 | 0.13 | 0.21 | Comparative Example |
| Z | 0.142 | 0.26 | 1.55 | 0.008 | 0.0010 | 1.09 | 0.0038 | 0.22 | 0.01 | 0.19 | Comparative Example |
| AA | 0.155 | 1.32 | 1.55 | 0.007 | 0.0010 | 0.05 | 0.0044 | 0.21 | 0.12 | 0.20 | Comparative Example |
| AB | 0.160 | 0.23 | 1.54 | 0.008 | 0.0009 | 1.22 | 0.0043 | 0.19 | 0.11 | 0.61 | Comparative Example |

Further, an alloying galvanizing was applied to parts of steels A, J, L and AA under a heating temperature of 680° C. which is not higher than $Ac_3$ and an alloying temperature of 560° C., which was maintained for 60 seconds, by using a continuous galvanizing line. In order to evaluate the outer appearance of the plated layer and the adhesivity of the plating, a 180° bending test was conducted based on JIS Z 2248, followed by attaching a tape (Dunplonpro No. 375 manufactured by Nitto Kako K.K.) to the bent portion and subsequently peeling off the tape to visually observe the surface state after the peeling off of the tape. The samples having the plating not peeled off at all were evaluated as "good", and the samples having the plating peeled off such that the peeling was recognized by the naked eyes was evaluated as "poor."

Table 2 shows the manufacturing conditions, Table 3 shows the properties of the steel sheet samples after the hot rolling and the pickling, and Table 4 shows the properties of the steel sheet samples after the galvanizing. As apparent from the experimental data, any of the Inventive Examples was found to exhibit a high yield ratio (YS/TS), compared with the Comparative Examples, and was also found to be excellent in the balance between the strength and the uniform elongation, in the stretch flangeability, and in the plating property. In contrast, the steel sheet samples for the Comparative Examples failing to fall within our range in at least one condition was found to fail to satisfy simultaneously all the properties including the high yield ratio, a good balance between the strength and the uniform elongation, a good stretch flangeability, and a good plating property.

TABLE 2

| No. | steel | Heating temperature (° C.) | finishing temperature (° C.) | average cooling rate to intermediate air-cooling temperature (° C./s) | intermediate air-cooling starting temperature (° C.) |
|---|---|---|---|---|---|
| 1 | A | 1250 | 860 | 135 | 685 |
| 2 | A | 1270 | 920 | 100 | 700 |
| 3 | A | 1270 | 845 | 110 | 750 |
| 4 | A | 1270 | 875 | 90 | 735 |
| 5 | A | 1250 | 840 | 60 | 690 |
| 6 | A | 1270 | 875 | 70*** | — |
| 7 | A | 1270 | 865 | 65*** | — |
| 8 | A | 1250 | 850 | 31 | 710 |
| 9 | B | 1280 | 880 | 120 | 700 |
| 10 | C | 1250 | 860 | 130 | 690 |
| 11 | D | 1270 | 880 | 80 | 675 |
| 12 | E | 1270 | 870 | 85 | 675 |
| 13 | F | 1270 | 950 | 100 | 720 |
| 14 | G | 1250 | 860 | 135 | 670 |
| 15 | H | 1250 | 840 | 95 | 685 |
| 16 | I | 1250 | 860 | 95 | 690 |
| 17 | J | 1250 | 860 | 100 | 690 |
| 18 | K | 1250 | 850 | 80 | 740 |
| 19 | L | 1250 | 860 | 140 | 690 |
| 20 | L | 1250 | 860 | 45 | 690 |
| 21 | L | 1250 | 860 | 95 | 690 |
| 22 | L | 1250 | 870 | 140 | 700 |
| 23 | L | 1250 | 870 | 140 | 680 |
| 24 | L | 1250 | 860 | 110 | 690 |
| 25 | L | 1250 | 870 | 90 | 700 |
| 26 | M | 1250 | 950 | 130 | 700 |
| 27 | M | 1250 | 850 | 130 | 685 |
| 28 | N | 1270 | 875 | 125 | 710 |
| 29 | O | 1250 | 850 | 105 | 690 |
| 30 | P | 1250 | 860 | 120 | 700 |
| 31 | Q | 1250 | 860 | 120 | 690 |
| 32 | Q | 1200 | 860 | 120 | 690 |
| 33 | R | 1270 | 870 | 130 | 675 |
| 34 | S | 1250 | 875 | 125 | 700 |
| 35 | T | 1250 | 875 | 125 | 680 |
| 36 | U | 1250 | 870 | 130 | 680 |
| 37 | V | 1270 | 890 | 130 | 675 |
| 38 | W | 1270 | 890 | 130 | 675 |
| 39 | X | 1280 | 900 | 100 | 710 |
| 40 | Y | 1250 | 890 | 90 | 700 |
| 41 | Z | 1250 | 860 | 135 | 690 |
| 42 | AA | 1250 | 870 | 135 | 680 |
| 43 | AB | 1250 | 860 | 120 | 700 |

| No. | intermediate air-cooling time (s) | intermediate air-cooling finish temperature (° C.) | Average cooling rate after intermediate air-cooling (° C./s) | coiling temperature (° C.) | kind of carbide *) |
|---|---|---|---|---|---|
| 1 | 5.0 | 660 | 55 | 430 | A |
| 2 | 2.1 | 690 | 60 | 390 | A |
| 3 | 5.5 | 723 | 100 | 480 | A |
| 4 | 2.0 | 725 | 65 | 480 | A |
| 5 | 4.8 | 666 | 40 | 450 | A |
| 6 | — | — | 70*** | 415 | A |
| 7 | — | — | 65*** | 470 | A |
| 8 | 4.5 | 688 | 30 | 430 | A |
| 9 | 5.5 | 673 | 50 | 450 | A |
| 10 | 5.0 | 665 | 60 | 430 | A |
| 11 | 2.5 | 663 | 60 | 480 | A |
| 12 | 2.5 | 663 | 60 | 480 | A |
| 13 | 3.7 | 702 | 65 | 460 | A |
| 14 | 4.5 | 648 | 60 | 520 | A |
| 15 | 5.5 | 658 | 45 | 450 | C |
| 16 | 5.0 | 665 | 45 | 430 | A |
| 17 | 5.5 | 663 | 45 | 430 | A |

TABLE 2-continued

| | | | | | |
|---|---|---|---|---|---|
| 18 | 6.0 | 710 | 50 | 400 | A, B |
| 19 | 5.0 | 665 | 60 | 430 | B |
| 20 | 5.5 | 663 | 45 | 430 | B |
| 21 | 5.5 | 663 | 45 | 440 | B |
| 22 | 3.5 | 683 | 50 | 480 | B |
| 23 | 3.5 | 663 | 50 | 380 | B |
| 24 | 5.5 | 663 | 45 | 570 | B |
| 25 | 4.5 | 678 | 65 | 300 | B |
| 26 | 5.0 | 675 | 60 | 430 | B |
| 27 | 5.0 | 660 | 60 | 430 | B |
| 28 | 4.5 | 688 | 60 | 460 | B |
| 29 | 2.0 | 680 | 90 | 410 | B |
| 30 | 5.5 | 673 | 60 | 450 | A, B |
| 31 | 5.0 | 665 | 55 | 430 | B |
| 32 | 5.5 | 663 | 55 | 430 | B |
| 33 | 3.5 | 658 | 65 | 470 | B |
| 34 | 4.5 | 678 | 60 | 440 | B |
| 35 | 4.5 | 658 | 60 | 470 | B |
| 36 | 5.0 | 655 | 65 | 470 | B |
| 37 | 5.0 | 650 | 65 | 450 | B |
| 38 | 4.5 | 653 | 60 | 450 | B |
| 39 | 5.0 | 685 | 45 | 450 | A, B |
| 40 | 5.0 | 675 | 40 | 430 | B |
| 41 | 5.5 | 663 | 45 | 430 | D |
| 42 | 5.0 | 655 | 40 | 440 | B |
| 43 | 5.0 | 675 | 45 | 450 | B, D |

| No. | particle size of carbide **) (nm) | volume percent of ferrite + bainite (vol %) | volume percent of bainite (vol %) | amount of retained γ (vol %) | Remarks |
|---|---|---|---|---|---|
| 1 | 9 | 89 | 50 | 10 | Inventive Example |
| 2 | 11 | 87 | 45 | 10 | Inventive Example |
| 3 | 8 | 84 | 49 | 15 | Inventive Example |
| 4 | 8 | 84 | 51 | 13 | Inventive Example |
| 5 | 10 | 87 | 40 | 11 | Inventive Example |
| 6 | 18 | 88 | 35 | 12 | Inventive Example |
| 7 | 20 | 87 | 27 | 11 | Inventive Example |
| 8 | 18 | 91 | 19 | 6 | Inventive Example |
| 9 | 12 | 85 | 50 | 14 | Inventive Example |
| 10 | 10 | 88 | 48 | 11 | Inventive Example |
| 11 | 10 | 90 | 56 | 8 | Inventive Example |
| 12 | 12 | 88 | 41 | 10 | Inventive Example |
| 13 | 25 | 90 | 38 | 9 | Inventive Example |
| 14 | 9 | 89 | 52 | 10 | Inventive Example |
| 15 | 45 | 86 | 42 | 6 | Comparative Example |
| 16 | 12 | 88 | 75 | 1 | Comparative Example |
| 17 | 11 | 90 | 49 | 7 | Comparative Example |
| 18 | 10 | 88 | 47 | 11 | Inventive Example |
| 19 | 12 | 87 | 45 | 12 | Inventive Example |
| 20 | 14 | 88 | 41 | 11 | Inventive Example |
| 21 | 12 | 87 | 43 | 12 | Inventive Example |
| 22 | 11 | 87 | 45 | 11 | Inventive Example |
| 23 | 11 | 90 | 45 | 9 | Inventive Example |
| 24 | 12 | 80 | 52 | 1 | Comparative Example |
| 25 | 10 | 60 | 15 | 2 | Comparative Example |
| 26 | 10 | 84 | 49 | 15 | Inventive Example |
| 27 | 12 | 86 | 47 | 13 | Inventive Example |
| 28 | 9 | 88 | 61 | 10 | Inventive Example |
| 29 | 17 | 95 | 20 | 5 | Inventive Example |
| 30 | 9 | 88 | 46 | 11 | Inventive Example |
| 31 | 10 | 86 | 44 | 13 | Inventive Example |
| 32 | 16 | 87 | 48 | 11 | Inventive Example |
| 33 | 15 | 88 | 53 | 10 | Inventive Example |
| 34 | 12 | 88 | 49 | 11 | Inventive Example |
| 35 | 10 | 87 | 50 | 11 | Inventive Example |
| 36 | 11 | 89 | 51 | 10 | Inventive Example |
| 37 | 20 | 85 | 45 | 13 | Inventive Example |
| 38 | 23 | 83 | 42 | 16 | Inventive Example |
| 39 | 13 | 77 | 47 | 8 | Comparative Example |
| 40 | 10 | 89 | 38 | 7 | Comparative Example |
| 41 | 15 | 85 | 76 | 4 | Comparative Example |
| 42 | 10 | 88 | 46 | 9 | Comparative Example |
| 43 | 33 | 90 | 41 | 7 | Comparative Example |

*) Kinds of carbides: A: Ti—Mo—C system B: Ti—V—Mo—C system C: Ti—C system D: V—C system

**) The particle size of carbide covers kinds A, B, C and D of carbides, and does not cover the iron-based carbide.

***average cooling rate to coiling temperature after hot-rolling

TABLE 3

| No. | Steel | YS (MPa) | TS (MPa) | YS/TS | U · El (%) | TS × U · El (MPa · %) | λ (%) | Remarks |
|---|---|---|---|---|---|---|---|---|
| 1 | A | 749 | 890 | 0.84 | 18.8 | 16732 | 162 | Inventive Example |
| 2 | A | 747 | 903 | 0.83 | 18.4 | 16615 | 135 | Inventive Example |
| 3 | A | 603 | 814 | 0.74 | 16.3 | 13268 | 163 | Inventive Example |
| 4 | A | 640 | 805 | 0.80 | 18.6 | 14973 | 164 | Inventive Example |
| 5 | A | 709 | 875 | 0.81 | 19.1 | 16713 | 166 | Inventive Example |
| 6 | A | 691 | 780 | 0.89 | 19.3 | 15054 | 156 | Inventive Example |
| 7 | A | 690 | 802 | 0.86 | 17.5 | 14035 | 154 | Inventive Example |
| 8 | A | 725 | 792 | 0.92 | 15.8 | 12514 | 142 | Inventive Example |
| 9 | B | 832 | 991 | 0.84 | 16.2 | 16054 | 129 | Inventive Example |
| 10 | C | 748 | 850 | 0.88 | 19.3 | 16405 | 165 | Inventive Example |
| 11 | D | 764 | 895 | 0.85 | 17.8 | 15931 | 156 | Inventive Example |
| 12 | E | 750 | 870 | 0.86 | 18.1 | 15747 | 159 | Inventive Example |
| 13 | F | 850 | 991 | 0.86 | 16.4 | 16252 | 133 | Inventive Example |
| 14 | G | 790 | 875 | 0.90 | 18.1 | 15838 | 161 | Inventive Example |
| 15 | H | 602 | 770 | 0.78 | 9.4 | 7238 | 81 | Comparative Example |
| 16 | I | 780 | 910 | 0.86 | 9.3 | 8463 | 76 | Comparative Example |
| 17 | J | 762 | 885 | 0.86 | 12.3 | 10886 | 118 | Comparative Example |
| 18 | K | 775 | 945 | 0.82 | 17.2 | 16254 | 145 | Inventive Example |
| 19 | L | 835 | 1010 | 0.83 | 16.8 | 16968 | 141 | Inventive Example |
| 20 | L | 815 | 993 | 0.82 | 16.6 | 16484 | 142 | Inventive Example |
| 21 | L | 820 | 998 | 0.82 | 18.8 | 18762 | 140 | Inventive Example |
| 22 | L | 811 | 987 | 0.82 | 17.8 | 17569 | 148 | Inventive Example |
| 23 | L | 828 | 1019 | 0.81 | 15.8 | 16100 | 138 | Inventive Example |
| 24 | L | 840 | 988 | 0.85 | 5.2 | 5138 | 75 | Comparative Example |
| 25 | L | 783 | 1024 | 0.76 | 6.8 | 6963 | 70 | Comparative Example |
| 26 | M | 1036 | 1205 | 0.86 | 16.9 | 20365 | 118 | Inventive Example |
| 27 | M | 1002 | 1192 | 0.84 | 16.1 | 19191 | 120 | Inventive Example |
| 28 | N | 1182 | 1370 | 0.86 | 11.2 | 15344 | 96 | Inventive Example |
| 29 | O | 831 | 981 | 0.85 | 16.2 | 15892 | 149 | Inventive Example |
| 30 | P | 862 | 995 | 0.87 | 16.4 | 16318 | 146 | Inventive Example |
| 31 | Q | 844 | 987 | 0.86 | 17.5 | 17273 | 144 | Inventive Example |
| 32 | Q | 805 | 981 | 0.82 | 16.5 | 16187 | 138 | Inventive Example |
| 33 | R | 877 | 1040 | 0.84 | 16.1 | 16744 | 140 | Inventive Example |
| 34 | S | 865 | 1008 | 0.86 | 16.3 | 16430 | 139 | Inventive Example |
| 35 | T | 846 | 994 | 0.85 | 16.9 | 16799 | 142 | Inventive Example |
| 36 | U | 872 | 990 | 0.88 | 16.5 | 16335 | 144 | Inventive Example |
| 37 | V | 846 | 1035 | 0.82 | 17.1 | 17699 | 137 | Inventive Example |
| 38 | W | 867 | 1063 | 0.82 | 16.8 | 17858 | 135 | Inventive Example |
| 39 | X | 784 | 1009 | 0.78 | 10.7 | 10796 | 74 | Comparative Example |
| 40 | Y | 792 | 951 | 0.83 | 9.4 | 8939 | 51 | Comparative Example |
| 41 | Z | 753 | 942 | 0.80 | 9.1 | 8572 | 98 | Comparative Example |
| 42 | AA | 808 | 1003 | 0.81 | 10.5 | 10532 | 109 | Comparative Example |
| 43 | AB | 942 | 1015 | 0.93 | 9.2 | 9338 | 81 | Comparative Example |

TABLE 4

| Steel | heating temperature (° C.) | finishing temperature (° C.) | average cooling rate to intermediate air-cooling starting temperature (° C./s) | intermediate air-cooling starting temperature (° C.) | intermediate air-cooling time(s) | intermediate air-cooling finish temperature (° C.) | average cooling rate after intermediate air-cooling (° C./s) |
|---|---|---|---|---|---|---|---|
| A | 1250 | 860 | 135 | 685 | 5.0 | 660 | 55 |
| J | 1250 | 860 | 100 | 690 | 5.5 | 663 | 45 |
| L | 1250 | 860 | 140 | 690 | 5.0 | 665 | 60 |
| AA | 1250 | 870 | 135 | 680 | 5.0 | 655 | 40 |

| Steel | coiling temperature (° C.) | kind of carbide *) | particle size of carbide **) (nm) | area ratio of fertile + bainite (%) | area ratio of bainite (%) | amount of retained γ (vol %) | Remarks |
|---|---|---|---|---|---|---|---|
| A | 430 | A | 15 | 86 | 48 | 13 | Inventive Example |
| J | 430 | A | 17 | 89 | 47 | 9 | Comparative Example |
| L | 430 | B | 16 | 85 | 43 | 14 | Inventive Example |
| AA | 440 | B | 14 | 88 | 44 | 7 | Comparative Example |

| Steel | YS (MPa) | TS (MPa) | YS/TS | U · El (%) | TS × U·El (MPa · %) | λ(%) | outer appearance after the plating | adhesivity of the plating | Remarks |
|---|---|---|---|---|---|---|---|---|---|
| A | 701 | 925 | 0.76 | 18.4 | 17020 | 157 | Good | good | Inventive Example |
| J | 692 | 908 | 0.76 | 11.6 | 10533 | 102 | partially not plated | poor | Comparative Example |

TABLE 4-continued

| | | | | | | | | | |
|---|---|---|---|---|---|---|---|---|---|
| L | 782 | 1017 | 0.77 | 17.4 | 17696 | 138 | Good | good | Inventive Example |
| AA | 751 | 1062 | 0.71 | 9.4 | 9983 | 98 | partially not plated | poor | Comparative Example |

*) Kinds of carbides: A: Ti—Mo—C system B: Ti—V—Mo—C system C: Ti—C system D: V—C system

**) The particle size of carbide covers kinds A, B, C and D of carbides, and does not cover the iron-based carbide.

We thus provide a high strength hot rolled steel sheet used in various fields including, for example, the use as a steel sheet for an automobile.

The invention claimed is:

1. A high strength steel sheet excellent in balance between strength and uniform elongation, consisting essentially of about 0.05 to about 0.25% of C, less than about 0.5% of Si, about 0.5 to about 3.0% of Mn, not more than about 0.06% of P, not more than about 0.01% of S, about 0.50 to about 3.0% of Sol, Al, not more than about 0.02% of N, about 0.1 to about 0.8% of Mo, about 0.02 to about 0.40 % of Ti by mass percentage, and the balance of Fe and inevitable impurities, the steel sheet has a structure formed of at least three phases including a banite phase, a retained austenite phase, and a ferrite phase having composite carbides containing Ti and Mo finely precipitated therein in a dispersion state, wherein the total volume of the ferrite phase and the bainite phase is not smaller than about 80%, the volume of the bainite phase is about 5% to about 60%, the volume of the retained austenite phase is about 3 to about 20%, and the steel sheet has a tensile strength of not lower than 780 MPa and a drilled hole expanding ratio of 118-166% and a TS x λ of 112,464 or more.

2. The high strength steel sheet according to claim 1, wherein the composite carbide containing Ti and Mo, which is present in the termite, phase, has an average carbide diameter not larger than 30 nm.

3. The high strength steel sheet according to claim 2, wherein the steel sheet has a zinc-based plated coating on the surface.

4. The high strength steel sheet according to claim 1. wherein the steel sheet has a zinc-based plated coating on the surface.

5. The high strength steel sheet according to claim 1, containing 0.0021-0.02% of N.

6. The high strength steel sheet according to claim 1, wherein the volume of retained austenite phase is 5 to about 20%.

7. A high strength steel sheet excellent in balance between strerath and uniform cdongation consisting essentially of about 0.05 to about 0.25% of C, less than about 0.5% of Si, about 0.5 to about 3.0% of Mn, not more than about 0.06% of P, not more than about 0.01% of S, about 0.50 to about 3.0% of Sol. Al, not more than about 0.02% of N, 0.1 to about 0.8% of Mo, about 0.02 to about 0.40% of Ti by mass percentage, about 0.05 to about 0.50% of V, and the balance of Fe and inevitable impurities, the steel sheet has a structure formed of at least three phases including a bainite phase, a retained austemte phase, and a ferrite phase having composite carbides containing Ti, Mo and V finely precipitated therein in a dispersion state, wherein the total volume of the ferrite phase and the bainite phase is not smaller than about 80%, the volume of the bainite phase is about 5% to about 60% the volume of the retained austenite phase is about 3 to about 20%, and the steel sheet has a tensile strength not lower than 780 MPa and a drilled hole expanding ratio of 118-166% and a TS x λ of 112,464 or more.

8. The high strength steel sheet according to claim 7, wherein the composite carbide containing Ti and Mo or the composite carbide containing Ti, Mn and V, which is present in the ferrite phase, has an average carbide diameter not larger than 30 nm.

9. The high strength steel sheet according to claim 8, wherein the steel sheet has a zinc-based plated coating on the surface.

10. The high strength steel sheet according to claim 7, wherein the steel sheet has a zincbased plated coating on the surface.

11. The high strength steel sheet according to clam 7, containing 0.0021-0.07% of N.

12. The high strength steel sheet according to claim 7, wherein the volume of retained austenite phase is 5 to about 20%.

* * * * *

UNITED STATES PATENT AND TRADEMARK OFFICE

CERTIFICATE OF CORRECTION

PATENT NO. : 8,815,025 B2
APPLICATION NO. : 11/592613
DATED : August 26, 2014
INVENTOR(S) : Yokota et al.

It is certified that error appears in the above-identified patent and that said Letters Patent is hereby corrected as shown below:

In the Claims

<u>In Column 20</u>

Claim 8, line 30, change “Mn” to --Mo--; and

Claim 10, line 37, change “zincbased” to --zinc-based--.

Signed and Sealed this
Thirty-first Day of March, 2015

Michelle K. Lee

Michelle K. Lee
*Director of the United States Patent and Trademark Office*